United States Patent [19]

Juguin et al.

[11] 4,435,274

[45] Mar. 6, 1984

[54] PROCESS FOR MANUFACTURING GASOLINE WITH UPGRADING OF HYDROCARBON OILS

[75] Inventors: Bernard Juguin, Rueil-Malmaison; Jean-Pierre Franck, Bougival; Yves Jacquin, Sevres; Christian Marcilly, Houilles; Germain Martino, Poissy, all of France

[73] Assignee: Institut Francais du Petrole, Rueil-Malmaison, France

[21] Appl. No.: 425,348

[22] Filed: Sep. 28, 1982

[30] Foreign Application Priority Data

Sep. 28, 1981 [FR] France ..... 81 18372

[51] Int. Cl.[3] ..... C10G 45/02; C10G 35/04; C10G 65/00

[52] U.S. Cl. ..... 208/80; 208/93; 208/134; 208/141

[58] Field of Search ..... 208/57, 79, 80, 93, 208/134, 141

[56] References Cited

U.S. PATENT DOCUMENTS

| | | | |
|---|---|---|---|
| 4,039,429 | 8/1977 | Klinken et al. | 208/80 X |
| 4,125,566 | 11/1978 | Dinh et al. | 208/93 X |
| 4,126,538 | 11/1978 | Goudriaan et al. | 208/80 |
| 4,133,841 | 1/1979 | Cosyns et al. | 208/80 X |

*Primary Examiner*—Delbert E. Gantz
*Assistant Examiner*—George Schmitkons
*Attorney, Agent, or Firm*—Millen & White

[57] ABSTRACT

Residual oils from steam-cracking or catalytic cracking, oils from coal liquefaction and oils from bituminous sands and shales are converted to gasoline by a process comprising the fractionation of the feed charge to a naphtha and a middle distillate: the naphtha, admixed with a gasoline cut "E", is hydrotreated and then dehydrogenated to gasoline; the middle distillate is hydrotreated and fractionated to gasoline and a heavier fraction, the heavier fraction is hydrocracked and fractionated, thus producing a gasoline cut which constitutes the above cut "E".

9 Claims, 1 Drawing Figure

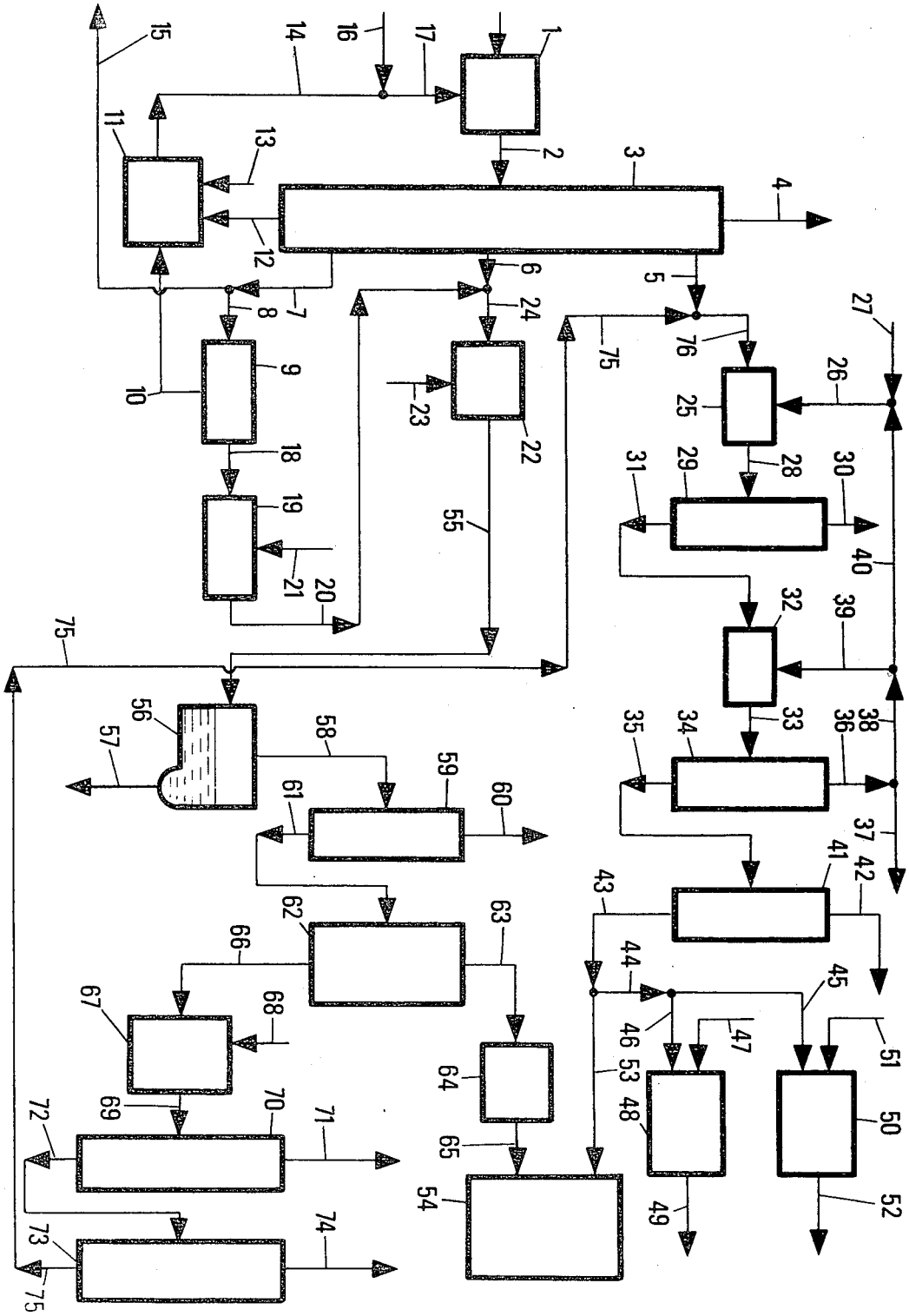
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71
72
73
74
75
76

PROCESS FOR MANUFACTURING GASOLINE WITH UPGRADING OF HYDROCARBON OILS

The present invention concerns a new process for treating a charge selected more particularly from the residual oils of the steam-cracking and catalytic cracking units, the oils obtained by coal hydroliquefaction and the oils extracted from bituminous sands and shales. The process according to the invention has for object to obtain regular or premium gasoline of good quality, specially for motor-cars, with a high yield.

The single accompanying drawing, illustrates the gist of the invention, wherein is treated an effluent from coal liquefaction.

The feed charge is withdrawn through line 2 from a coal liquefaction zone 1. The effluent stream is fractionated in a fractionation column or zone 3. Carbon dioxide, carbon monoxide, hydrogen sulfide and hydrocarbons with 1, 2, 3, and/or 4 carbon atoms per molecule are thus generally recovered. A naphtha, generally amounting to, for example, 20 to 60% by weight of the feed charge of line 2, is collected in duct 5. This naphtha, containing at least 50% of constituents distilling between about 25° and 200° C. (eventually 30° and 180° C.), usually comprises at least 40% b.w. of alkylated or unalkylated naphthenic hydrocarbons having generally from 6 to 15 carbon atoms per molecule, and generally contains sulfur, nitrogen and oxygen impurities in proportions respectively higher than 300 ppm for sulfur, 300 ppm for nitrogen and 300 ppm for oxygen, and sometimes respectively higher than 1000 ppm for sulfur, 1000 ppm for nitrogen and 2000 ppm for oxygen.

The naphtha is supplied through ducts 5 and 76 to a conventional catalytic hydrotreatment zone fed with hydrogen from ducts 27 and 26. The hydrotreatment is preferably performed under a pressure of 50 to 65 bars at the temperature conventionally used for this type of reaction and in the presence of a conventional catalyst.

A gasoline cut "E", as hereinafter defined, withdrawn through duct 75 from a fractionation zone 73 is also introduced into the hydrotreatment zone. The effluent from the hydrotreatment zone is fed through duct 28 to a fractionation zone 29 wherefrom are discharged, through duct 30, hydrogen sulfide, ammonia and water and, through duct 31, a fraction which contains generally, at this stage, less than 60 ppm of nitrogen, less than 300 ppm of sulfur and less than 700 ppm of oxygen. This fraction is introduced into a catalytic dehydrogenation zone 32 operated at a pressure of, for example, about 1 to 20 bars, at a temperature of, for example, 400° to 650° C. and at velocity of 1 to 10 volumes of liquid charge per volume of catalyst per hour (the catalyst is preferably neutral or very weakly acidic and the selection of the pressure and temperature depends thereon; for example, the selected catalyst is $Cr_2O_3/Al_2O_3$).

The effluent stream from the dehydrogenation zone 32 is fed through duct 33 to the fractionation zone 34; wherefrom is withdrawn, through duct 36, a mixture (called "M") of hydrogen and hydrocarbons with 1, 2 and/or 3 carbon atoms (this mixture can be partly discharged through duct 37 and/or recycled through lines 38 and 39 to the dehydrogenation zone 32 and/or through ducts 38, 40 and 26 to the hydrotreatment zone 25); and, through duct 35, an effluent stream which is fed to a fractionation zone 41:hydrocarbons having 3 and 4 carbon atoms are recovered in duct 42 and a gasoline fraction in ducts 43 and 53, which fraction is fed to the gasoline pool 54. Whenever, desired, at least a portion of the gasoline fraction of duct 43 is supplied, through ducts 44 and 46, to a hydrodealkylation zone 48 (this zone is fed with hydrogen through duct 47 and the hydrodealkylation effluent is discharged through duct 49) and/or at least a portion thereof, through ducts 44 and 45, to an optional hydrogenolysis zone 50 (fed with hydrogen through duct 51, the hydrogenolysis effluent being discharged through duct 52). The hydrodealkylation reaction yields benzene and the hydrogenolysis reaction yields methane.

A middle distillate comprising at least 50% of constituents distilling between 170° and 360° C. and amounting to about 15 to 75% of the feed charge of duct 2 is discharged through duct 6 from the fractionation zone 3. This distillate is supplied through duct 24 to a conventional hydrotreatment zone 22 fed with hydrogen through duct 23. The outflow, discharged through duct 55, settles in zone 56 wherefrom are discharged at least a part of the water contained therein (through duct 57) and a hydrocarbon fraction, through duct 58. The latter fraction is fed to a first fractionation zone 59 to remove hydrogen sulfide, ammonia and water through duct 60; the effluent stream of the first separation zone 59 is supplied, through duct 61, to a second separation zone 62. Gasoline is thus recovered in duct 63; it is supplied through duct 65 to the gasoline pool, after optional sweetening in the sweetening zone 64. A fraction heavier than gasoline is also obtained in duct 66; it is fed to a hydrocracking zone 67 (also fed with hydrogen through duct 68); an effluent stream, discharged through duct 69, is supplied to a fractionation zone 70 in order to remove, through duct 71, hydrogen sulfide, ammonia, water and hydrocarbons with 1 or 2 carbon atoms per molecule. A hydrocarbon fraction, containing hydrocarbons with at least 3 carbon atoms, per molecule, is recovered in duct 72; this fraction is supplied to a fractionation column 73 wherefrom are discharged, on the one hand, through duct 74, hydrocarbons having 3 and 4 carbon atoms, and, on the other hand, through duct 75, a gasoline cut called "E" which is recycled to line 76 and to the catalytic hydrotreatment zone 25.

A heavy gas oil comprising at least 50% of constituents distilling above 360° C., optionally 400° C., is withdrawn through duct 7; this gas oil may be recovered as final product. It can however be advantageous to admix at least a fraction thereof, in line 20, with the middle distillate of duct 6 and to subject it to a hydrotreatment in zone 22, as hereinbefore explained. In that case, it is often preferable to subject the gas oil to a conventional hydrodemetallation in zone 19, fed with hydrogen through duct 21, the gas oil being supplied through duct 18. It is also preferable to deasphalt the gas oil prior to the hydrodemetallation:the gas oil, discharged through ducts 7 and 8 from the fractionation zone 3, is supplied to the deasphalting zone 9 and then, through duct 18, to the demetallation zone 19.

The residue discharged through duct 12 from the fractionation zone 3 can be optionally upgraded, for example, by gasifying in zone 11, the resultant hydrogen being supplied through lines 14 and 17 to the coal liquefaction zone 1, fed with fresh hydrogen through duct 16. At least a portion of the residue of the deasphalting zone 9 can be fed, through duct 10, to the gasifying zone 11. Finally, a portion of the gas oil of duct 7 can advantageously be fed, through duct 15, to the oil pasting zone used in the coal liquefaction, the oil being, for example, an anthracenic oil.

The invention preferably concerns a process for manufacturing gasoline from a feed charge selected from the coal hydroliquefaction oils, which process consists of fractionating the charge, in order to separately recover:

(α) a fraction containing carbon monoxide, carbon dioxide, hydrogen sulfide and hydrocarbons having generally from 1 to 4 carbon atoms per molecule (line 4), (β) a naphta distilling between about 25° and 200° C., comprising at least 40% b.w. of naphthenic hydrocarbons and having contents of sulfur-, nitrogen-and oxygen-containing impurities respectively higher than 1000 ppm of sulfur, 1000 ppm of nitrogen and 2000 ppm of oxygen, said naphtha amounting to 20 to 60% b.w. of said charge (line 5), (γ) a middle distillate amounting to 15 to 75% b.w. of said charge and boiling between about 200° and 360° C. (line 6), (δ) a gas oil amounting to about 2 to 35% b.w. of said charge (line 7) and boiling generally above 360° C., and (ε) a residue (line 12), the process being further essentially characterized in that, (a) the naphtha (β), in admixture with a gasoline cut called "E", as hereinafter defined, is subjected to a hydrotreatment in a hydrotreatment zone (25), (b) the effluent of the hydrotreatment stage (a) is fed to a separation zone (29) to remove at least the major part of hydrogen sulfide, ammonia and water, (c) the purified effluent of the hydrotreatment stage, recovered from step (b), is supplied to a dehydrogenation zone (32) where it is treated, in the presence of a hydrogenation catalyst, at 400° to 650° C. under a pressure of 1 to 20 bars, at velocity of 1 to 10 volumes of liquid charge per volume of catalyst, per hour.

(d) the effluent of the dehydrogenation zone is fed to a first fractionation zone (34) wherefrom are discharged, on the one hand, a mixture called M, generally consisting of hydrogen and hydrocarbons having 1, 2 and 3 carbon atoms per molecule, and, on the other hand, a hydrocarbon fraction which is supplied to a second separation or fractionation zone (41), wherefrom are discharged, on the one hand, hydrocarbons having 3 and 4 carbon atoms per molecule and, on the other hand, a gasoline fraction (line 53), (e) the middle distillate (γ) is supplied to a catalytic hydrotreatment unit (22), (f) the hydrotreatment effluent is made free of the major portion of the water contained therein (in zone 56) and then fed to a separation zone (59) to remove hydrogen sulfide, ammonia and water, (g) the effluent obtained at the end of step (f) is fed to a fractionation zone (62) wherefrom are recovered, on the one hand, a fraction consisting essentially of gasoline, recovered as product (line 65) and, on the other hand, a heavier fraction (line 66), (h) said heavier fraction obtained in step (g) is supplied to hydrocracking zone (67), (i) the hydrocracking effluent is supplied to a fractionation unit (70) to obtain, on the one hand, a fraction containing, in particular, hydrogen sulfide and ammonia, water and hydrocarbons having 1 and 2 carbon atoms per molecule and, on the other hand, a hydrocarbon fraction consisting of hydrocarbons having at least 3 carbon atoms per molecule, (j) said hydrocarbon fraction, collected in step (i), is supplied to a fractionation zone (73) where are collected, on the one hand, hydrocarbons having 3 and 4 carbon atoms per molecule and, on the other hand, a gasoline called "E" which is at least partly recycled (through line 75) to the hydrotreatment zone defined in step (a).

According to an alternative embodiment, the mixture M, recovered at the end of step (d), can be fed at least partly to the dehydrogenation zone (32) defined in step (c) and/or to the hydrotreatment zone (25) defined in step (a).

Optionally, at least a portion of the gasoline of line (43), obtained at the end of step (d), is supplied to a hydrodealkylation zone (48), so as to produce benzene, and/or to a hydrogenolysis zone (50), to produce methane.

In the same, way a preferred treatment consists of admixing at least a part of the heavy gas oil (δ) with the middle distillate (γ) and feeding the mixture to the hydrotreatment unit 22.

This gas oil, before being admixed with the middle distillate, can be first subjected to a demetallation reaction (zone 19); before the demetallation reaction, the gas oil can be subjected to deasphalting (zone 9).

EXAMPLE 102 kg of an effluent stream from coal liquefaction are discharged from zone 1 and fractionated in zone 3, thus supplying:

1 kg of a mixture of CO, $CO_2$, $H_2S$ and $C_1$ to $C_4$ hydrocarbons (line 4, fraction called α), 28 kg of naphtha (line 5, fraction called β); distillation ASTM: 90°–200° C., 66 kg of a middle distillate (line 6, fraction called γ); distillation ASTM:200°–350° C., 6 kg of heavy gas oil (line 7, fraction called δ); distillation:higher than about 360° C., 1 kg of residue (line 12, fraction called ε).

The naphtha contains 55% b.w. of naphthenic hydrocarbons, 1500 ppm of sulfur, 2000 ppm of nitrogen and 7000 ppm of oxygen. It is admixed with 35 kg of gasoline from line 75, itself containing 700 ppm of sulfur, 900 ppm of nitrogen and 3100 ppm of oxygen. This mixture (line 76) is subjected in zone 25 to a hydrotreatment on a catalyst of nickel-molybdenum on alumina, at 55 bars, 380° C. and a VVH of 3. 63 kg of a product containing 1 ppm of sulfur, 20 ppm of nitrogen and 140 ppm of oxygen is obtained in duct 31. This product is dehydrogenated in zone 32, at 10 bars, 510° C. and a VVH of 2. The catalyst comprises 0.2% (b.w.) of platinum and 0.2% of tungsten, these two metals being deposited on γ alumina (69 $m^2/g$). At the end of this treatment and of the separation steps in zones 34 and 41, 59 kg of gasoline of RON 98, obtained in duct 43, are fed to the gasoline pool 54. The middle distillate of line 6 is admixed with the heavy gas oil of line 7. Before effecting this mixture, the heavy gas oil is subjected to hydrodemetallation at 50 bars, 390° C. and a VVH of 1 (catalyst:Co-Mo/$Al_2O_3$). 5 kg of gas oil, recovered in line 20, are added to the 66 kg of middle distillate of line 6. The mixture of line 24 contains 7700 ppm of sulfur, 6200 ppm of nitrogen and 17000 ppm of oxygen. The hydrotreatment to which is subjected the mixture of line 24 is effected at 90 bars, 400° C. and a VVH of 0.5, in the presence of a Ni-Mo/$Al_2O_3$ catalyst. The effluent obtained from this treatment and from the separation zones 56 and 59 contains (line 61) 60 ppm of sulfur, 300 ppm of nitrogen and 300 ppm of oxygen.

After fractionation in zone 62, there is obtained 27 kg of a gasoline of RON 97 (which can be subjected, if desired, to sweetening) containing 10 ppm of sulfur, 30 ppm of nitrogen and 20 ppm of oxygen. These 27 kg of gasoline are fed to the gasoline pool 54 through duct 65. There are obtained in duct 66, 40 kg of product which is subjected to hydrocracking in zone 67, at 90 bars, 400° C. and a VVH of 1, on a catalyst consisting of a mixture of Ni-Mo/$Al_2O_3$ and Pd/zeolite. After hydrocracking and fractionation in zones 70 and 73, there are obtained 35 kg of gasoline which is admixed, as shown above, in line 75, with the naphtha of line 5.

At the end of the operation, there are collected, in the gasoline pool 54, the 59 kg of line 43 and the 27 kg of line 65, thus 86 kg of premium gasoline for motor-car.

What we claim is:

1. A process for manufacturing gasoline from a feed charge selected from residual oils of the steam-cracking and catalytic cracking units, oils obtained by hydroliquefaction of coal and oils recovered from bituminous sands and shales, in which process and the feed charge is fractionated and at least the two following fractions are recovered separately:

a naphtha comprising at least 50% of constituents distilling between 25° and 200° C. and containing at least 40% by weight of naphthenic hydrocarbons and at least 300 ppm of sulfur, 300 ppm of nitrogen and 300 ppm of oxygen, and a middle distillate comprising at least 50% of constituents distilling between about 200° and 360° C., and process being characterized by the steps of:

(a) admixing said naphtha with a gasoline cut "E" defined below, contacting the resultant mixture with a hydrotreatment catalyst, under hydrotreatment conditions, and recovering a hydrotreated naphtha, (b) contacting the hydrotreated naphtha with a dehydrogenation catalyst under dehydrogenation conditions and fractionating the dehydrogenation product to obtain a gasoline fraction, (c) contacting said middle distillate with a hydrotreatment catalyst, under hydrotreatment conditions, and fractionating the hydrotreatment product to separately obtain a gasoline fraction and a heavier fraction, (d) contacting the heavier fraction, obtained in step (c), with a hydrocracking catalyst, under hydrocracking conditions, and fractionating the hydrocracking product to obtain a gasoline cut called "E", and (e) feeding the gasoline cut "E" to step (a) to be admixed with said naphtha.

2. A process according to claim 1, wherein, when fractionating the feed charge, at leat one heavy distillate fraction is also isolated, at least 50% of the constituents of which distill above 360° C., and this heavy distillate fraction is admixed with said middle distillate, the resultant mixture being hydrotreated in step (c).

3. A process according to claim 1, wherein, when fractionating the feed charge, at least one heavy distillate fraction is isolated, at least 50% of the constituents of which distill above 360° C., this heavy distillate fraction is contacted with a demetallation catalyst, under demetallation conditions, and a demetallated heavy distillate fraction is recovered and admixed with said middle distillate, the resultant mixture being hydrotreated in step (c).

4. A process according to claim 1 for manufacturing gasoline from a feed charge being an oil obtained from coal hydroliquefaction, said process consisting of subjecting the feed charge to a fractionation to recover, in particular:

(α) a fraction containing carbon monoxide, carbon dioxide, hydrogen sulfide and hydrocarbons having generally from 1 to 4 carbon atoms per molecule, (β) a naphtha distilling between about 25° and 200° C. comprising at least 40% b.w. of naphthenic hydrocarbons and having contents of sulfur-, nitrogen- and oxygen-containing impurities respectively higher than 1000 ppm of sulfur, 1000 ppm of nitrogen and 200 ppm of oxygen, said naphtha amounting to 20 to 60% b.w. of said charge, (γ) a middle distillate amounting to 15 to 75% by weight of said charge and boiling between about 170° and 360° C., (δ) a gas oil amounting to about 2 to 35% by weight of said charge and boiling generally above 360° C., and (ε) a residue, the process being further characterized in that, (a) the naphtha (β), in admixture with a gasoline cut called "E", as hereinafter defined, is subjected to a hydrotreatment in a hydrotreatment zone, (b) the effluent of the hydrotreatment stage (a) is fed to a separation zone to remove at least the major part of hydrogen sulfide, ammonia and water, (c) the purified effluent of the hydrotreatment stage, recovered from step (b), is supplied to a dehydrogenation zone where it is treated, in the presence of a dehydrogenation catalyst, at 400° to 650° C. under a pressure of 1 to 20 bars, at velocity of 1 to 10 volumes of liquid charge per volume of catalyst, per hour.

(d) the effluent of the dehydrogenation zone is fed to a first fractionation zone wherefrom are discharged, on the one hand, a mixture called M, generally consisting of hydrogen and hydrocarbons having 1, 2 and 3 carbon atoms per molecule, and, on the other hand, a hydrocarbon fraction which is supplied to a second separation or fractionation zone, wherefrom are discharged, on the one hand, hydrocarbons having 3 and 4 carbon atoms per molecule and, on the other hand, a gasoline fraction, (e) the middle distillate (γ) is supplied to a catalytic hydrotreatment unit, (f) the hydrotreatment effluent is made free of the major portion of the water contained therein and then fed to a separation zone to remove hydrogen sulfide, ammonia and water, (g) the effluent obtained at the end of step (f) is fed to a fractionation zone wherefrom are recovered on the one hand, a fraction consisting essentially of gasoline, recovered as product and, on the other hand, a heavier fraction, (h) said heavier fraction obtained in step (g) is supplied to a hydrocracking zone, (i) the hydrocracking effluent is supplied to a fractionation unit to obtain, on the one hand, a fraction containing in particular inter alia, hydrogen sulfide and ammonia, water and hydrocarbons having 1 and 2 carbon atoms per molecule and, on the other hand, a hydrocarbon fraction consisting of hydrocarbons having at least 3 carbon atoms per molecule, (j) said hydrocarbon fraction, collected in step (i), is supplied to a fractionation zone where are collected, on the one hand, hydrocarbons having 3 and 4 carbon atoms per molecule and, on the other hand, gasoline called "E" which is at least partly recycled to the hydrotreatment zone defined in step (a).

5. A process according to claim 4, wherein the mixture M, recovered from step (d) is fed at least partly to the dehydrogenation zone defined in step (c).

6. A process according to claim 4, wherein the mixture M, recovered from step (d) is fed at least partly to the hydrotreatment zone defined in step (a).

7. A process according to claim 4, wherein at least a portion of the gasoline recovered from step (d) is fed to a hydrodealkylation zone, in order to produce benzene.

8. A process according to claim 4, wherein at least a portion of the gasoline obtained at the end of step (d) is fed to a hydrogenolysis zone, in order to produce methane.

9. A process according to claim 3, wherein, prior to the demetallation reaction, the gas oil is subjected to deasphalting.

* * * * *